US005474244A

United States Patent [19]

Götz

[11] Patent Number: 5,474,244

[45] Date of Patent: Dec. 12, 1995

[54] MEANS FOR ATTACHING AN IMPACT MEMBER TO A COARSE REDUCTION IMPACT CRUSHER

[75] Inventor: Bruno Götz, Oedheim, Germany

[73] Assignee: Paul Bohringer, Oedheim, Germany

[21] Appl. No.: 296,798

[22] Filed: Aug. 26, 1994

[30] Foreign Application Priority Data

Aug. 26, 1993 [DE] Germany ..... 9312822 U

[51] Int. Cl.[6] ..... B02C 13/28

[52] U.S. Cl. ..... 241/189.1; 241/192; 241/195

[58] Field of Search ..... 241/189.1, 191, 241/192, 195

[56] References Cited

U.S. PATENT DOCUMENTS

| | | | |
|---|---|---|---|
| 3,784,117 | 1/1974 | Koenig et al. | 241/191 |
| 4,679,740 | 7/1987 | Orphall | 241/189.1 |
| 4,720,052 | 1/1988 | Hasenfuss et al. | 241/192 |
| 4,915,309 | 4/1990 | Schmidt | 241/191 |
| 5,320,292 | 6/1994 | Smith | 241/191 |
| 5,395,063 | 3/1995 | Schrodl | 241/195 |

FOREIGN PATENT DOCUMENTS

| | | |
|---|---|---|
| 930839 | 7/1955 | Germany . |
| 351906 | 2/1978 | Germany . |
| 0320759A3 | 12/1988 | Germany . |

*Primary Examiner*—Mark Rosenbaum
*Assistant Examiner*—John M. Husar
*Attorney, Agent, or Firm*—Jacobson, Price, Holman & Stern

[57] ABSTRACT

A To facilitate manipulation of an impact member 20 of a coarse reduction impact crusher, the impact member 20 together with its wedge members 22 is only loosely inserted in an accommodating cavity 14 for the impact member, whereby when rotation of a rotor 10 is started the impact member 20 and wedge members 22 are urged by the resulting centrifugal force from a disengaged position near the axis of the rotor into a wedged position relatively distant from said axis.

11 Claims, 1 Drawing Sheet

26
16
18
30
14
26
28
22
32
12
24
20
14
18
14
24
16
18
10

MEANS FOR ATTACHING AN IMPACT MEMBER TO A COARSE REDUCTION IMPACT CRUSHER

This invention relates to a coarse reduction impact crusher having a rotor which bears the impact members, which impact members are fixed in recesses in the rotor by means of wedge members (hereinafter also to be referred to as "wedges").

BACKGROUND OF THE INVENTION

Coarse reduction impact crushers are employed for breaking rock. A rotor is disposed in the housing of the crusher, which rotor has a preferred operating direction but can be reversed.

The crushing tools employed in the crusher comprise a plurality of impact members. These tools are subject to wear, and therefore are replaceably fixed to the rotor, namely they are fixed in suitable accommodation cavities in the rotor by means of wedges. The wedges are driven into a fixed wedged position by mechanical impact means or hydraulic means. Because the tools (impact members) are subject to wear, they are symmetrically configured, so that when one impact edge experiences excessive wear one need only rotate the impact member in its accommodation cavity and re-fix it, to take advantage of a second, fresh impact edge.

Known means of fixing impact members have certain drawbacks, e.g., when mechanical wedge means are used, dust and fine particles tend to cause the impact members to become jammed, so that they can be rotated or replaced only with difficulty and corresponding expense. Hydraulic fixing systems are costly, because for control purposes the hydraulic lines must be extended to the exterior from the rotating rotor.

The underlying problem of the invention is to refine the known system wherein the impact members are mechanically fixed in their respective accommodating cavities by means of wedges, such that (in the refinement) the wedged configurations or wedges are easily and readily releasable, or may even release themselves when the rotor is stopped.

SUMMARY OF THE INVENTION

According to the invention the impact members and their respective wedges (one or more wedges per impact member) are slidably disposed in a plurality of respective accommodating cavities in the rotor, whereby a cavity serves to accommodate a respective impact member (or members), and wherein the impact members and wedge members can move under the influence of centrifugal force, such movement being between a released position relatively close to the rotational axis and a wedged position relatively distant from the rotational axis.

It will be appreciated that with this solution each impact member and its corresponding wedge(s) are readily installed in the respective accommodating cavity, obviously at a time when the rotor is stopped. In this rest position (also in the nature of a disengaged position), with the rotor stopped, no mechanical operations and no hydraulic means need be provided in order to achieve fixing of the impact members. Rather, after the impact members have been installed in the disengaged position on the rotor, one need only start rotation of the rotor. The resulting centrifugal forces will then cause the impact members and wedge(s) to move from their originally assumed disengaged positions and into positions more distant from the axis, in which latter positions fixation by wedging will occur. For this it is sufficient for the two parts and/or the wall(s) of the accommodating cavity to undergo corresponding "ausforming" deformation.

If it is necessary or desirable to stop the rotor, due to wear or for other reasons, the centrifugal force which has supplied the wedging force of course disappears. Accordingly, the parts separate from each other and again lie loose in the accommodation cavity.

It is evident that the direction of shifting of the parts between the disengaged position and the wedged position should be at least approximately radial.

In a preferred embodiment of the present invention means are provided whereby, when the rotor begins rotation, first the impact member is moved to its wedging position and then the wedge is moved to its wedging position. That is, the wedge moves thusly only after a slight delay. This can be achieved by providing that the distance of the center of inertia of the impact member from the rotational axis is greater than the distance of the center of inertia of the associated wedge from the rotational axis. In this way, when the rotor is started in rotation, the centrifugal force needed to move the impact member from the disengaged position to the wedging position is reached sooner than the corresponding force for the associated wedge member. Accordingly, the wedge member will not move against and fixingly wedge the impact member until the impact member has essentially reached its operating position under the action of the centrifugal force.

Upon stopping of the rotor, one can facilitate the loosening of the parts which have become wedged together in the wedged position if the region of the wedge which lies against the impact member is provided with a wedge inclination such that the impact member does not become jammed under the operating conditions experienced.

One can achieve conditions of movement for the wedging and re-loosening of the impact member, depending on the angular velocity of rotation of the rotor, which conditions are easy to manage, if only one impact member and one wedge member, and not more, are disposed in a given accommodating cavity. However, it is also possible to apply the same principle (i.e., the principle which underlies the invention) to an arrangement comprising a total of more than two impact members and wedge members, particularly if suitable guide means are provided for said members. Moreover, it is possible to operate with unequal numbers of impact members and wedge members; e.g., for one impact member to be wedged by a plurality of wedge members. The free mobility has a beneficial influence on the effective forces and thereby on the course of the movements.

In a further preferred aspect of the present invention, the cavity for accommodating the impact member has a large opening on the peripheral surface of the rotor, so that the wedge member and particularly the impact member can be readily inserted. However, means should be provided so that this opening which is chosen to be large in order to facilitate manipulation can be reduced in size so that the impact member and wedge member are not driven out of the accommodating cavity under the influence of the centrifugal forces but only come to be supported against each other and the boundaries of said cavity.

Accordingly, in a preferred embodiment of the invention, pieces are provided for the purpose of reducing the opening size which extend approximately in the tangential direction (i.e., normal to the radius of and in a plane of rotation of the rotor), over the radially outer opening of the cavity for accommodating the impact member. One of said pieces, namely an abutment beam for the impact member, is fixed to the rotor, has an inclined surface which provides a positioning means for the impact member, and extends out over the radially outer opening of the accommodating cavity such that said beam can be engaged on its underside in said extended region by a thrust member projecting outward from the impact member. When rotation of the rotor commences, the impact member is then urged radially outward from its loose position, such that said thrust member comes to rest against the underside of the abutment beam, while at the same time the impact member comes to be supported against the corresponding wedging surface of the abutment beam. In this way, means are provided to correctly position the impact member prior to its being wedged by the wedge member.

In another preferred embodiment of the present invention, a limiting plate is releasably fixed to the rotor (e.g., by screws) on the opposite side of the radially outer opening of the cavity for accommodating the impact member, which side is namely the side opposite to that of the abutment beam. The limiting plate overlaps the impact member in a region of the accommodating cavity, providing fixing means and at the same time providing additional means of closing off the accommodating cavity.

With this particular arrangement, it may also be advantageous to provide the impact member with breakage loci in the form of bores, affording a kind of overload protection, whereby when a reaction force exerted by a foreign body in the crushing space is transmitted to the impact member, the impact member will break at the breakage loci and will disintegrate into small pieces which are relatively easy to extract from the coarse reduction impact crusher. With this type of protection, collateral damage is also minimized.

Additional details, advantages, and features of the invention will be apparent from the following description with reference to FIG. 1. For the purposes of disclosure of matter essential to the invention, all details and features of the Figure not expressly described hereinbelow are incorporated herein by reference.

DESCRIPTION OF THE PREFERRED EMBODIMENT

Figure 1:
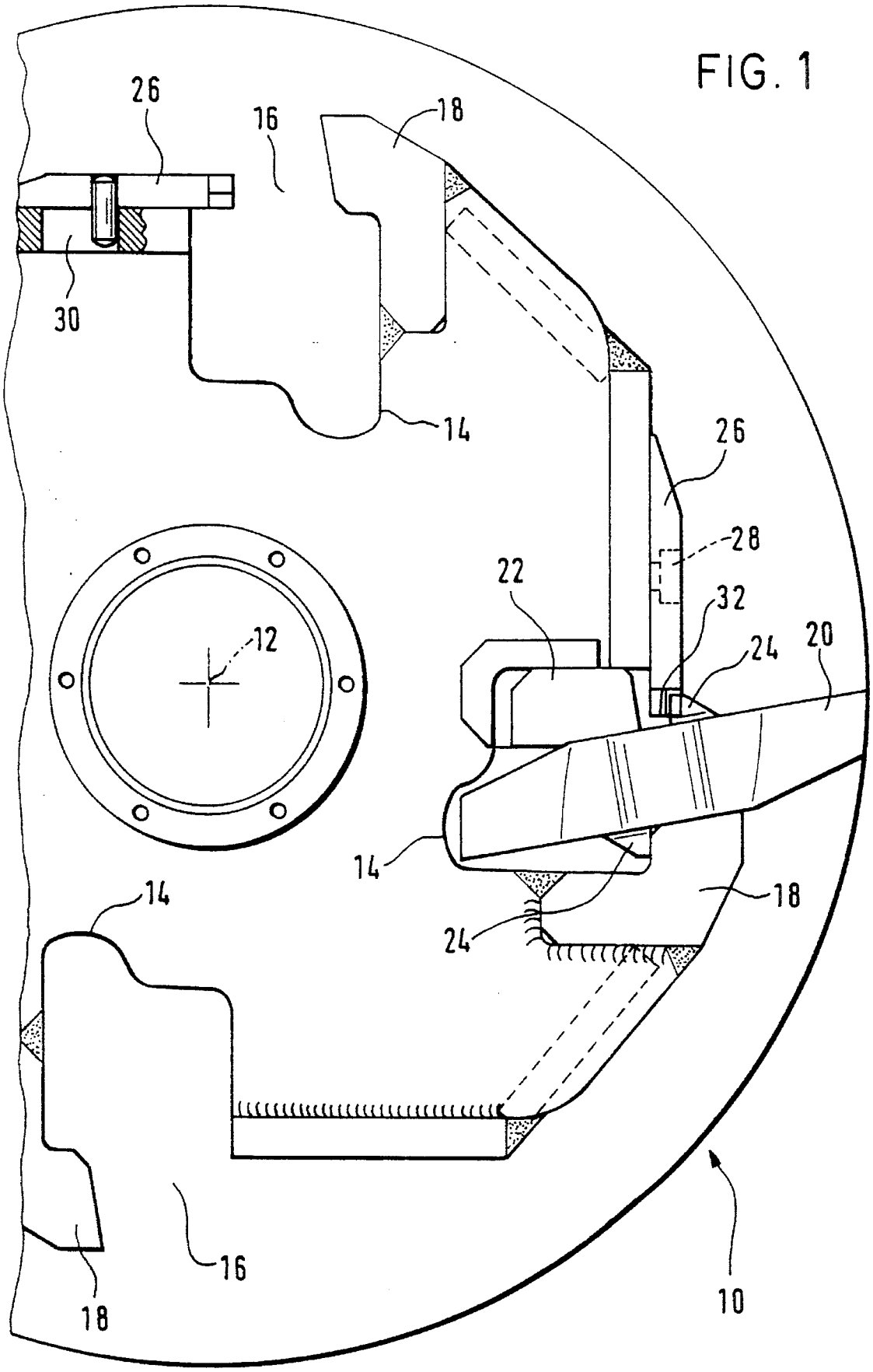
FIG. 1 shows a partial end view, in partial cross section, of the rotor of a coarse reduction impact crusher the axis of which is perpendicular to the plane of the paper.

With reference to FIG. 1, rotor 10 of a coarse reduction impact crusher revolves around an axis of rotation 12. The rotor can be stopped and can be rotated in both rotational directions. Four accommodation cavities 14 for accommodating impact members are formed on the outer periphery of the rotor 10; these are disposed at a mutual angular separation of about 90°. Each accommodation cavity 14 has a radially outer opening 16 through which it communicates with the exterior at the periphery of the rotor 10. The radially inner base of each opening 16 has a stepped configuration. Beneath an abutment beam 18 a relatively deep recess zone is provided for loose insertion of the impact member 20. Next to said recess zone, the base has a support structure for an associated wedge 22 when said wedge is in the "rest" position, which support structure is somewhat farther from the axis than the recess zone part of the cavity 14 which accommodates the impact member 20.

The impact members 20 preferably have a symmetric shape, which is known (see FIG. 1). The symmetry enables reversing the members 20 by mere rotation into any of four positions, depending on the conditions of use and on the wear experienced. Replacement is necessary only after complete wear, which is approximately four-fold. Obviously, appropriate known and customary measures may be employed (not shown in the exemplary embodiment illustrated in FIG. 1) to extend service life by stepwise advancing of the impact member occasionally, as wear proceeds during service.

A critical feature here is that the impact member 20 can be installed and emplaced loosely through the outer opening 16 and into the deep recess of the bottom of the corresponding accommodating cavity 14.

At this location, i.e., at the outer opening 16 the abutment beam 18 extends out over the cavity for accommodating the impact member, said extension being in approximately the rotationally tangential direction. An inclined surface at the head of the abutment beam 18 serves to support and position the impact member 20. In addition, the impact member has two thrust-type supporting members 24 (also symmetrically disposed) which extend along the radially disposed surfaces of the impact member 20. In the wedged position illustrated in FIG. 1, one of these thrust supporting members 24, seen in operation, extends under the head of the abutment beam 18, thereby limiting the radial movement of the impact member 20 when said member is under the influence of centrifugal force.

On the opposite side of the outer opening 16 a limiting plate 26 extends over said opening. Plate 26 is releasably fixed to the outer periphery of the rotor and is disposed nearly or approximately tangentially thereto. The limiting plate 26 may be attached to the rotor by a non-removeable screw 28 or the like. Advantageously, plate 26 is associated with a guideway on the rotor, so that when the screw 28 is loosened the plate and the screw 28 can be easily slide in and out between a retracted position in which the plate does not extend over the opening 16 and the position illustrated in FIG. 1. To provide freedom of movement for the screw 28, the limiting plate 26 is provided with a suitable longitudinal slot 30, which can be seen in the left upper part of FIG. 1. In addition, the limiting plate 26 has a recess 32 on its upper side, to accommodate the thrust supporting member 24 which is not currently in use.

Accordingly, with the parts positioned as in the arrangement illustrated in FIG. 1, there is maximal outward closure of the cavity 14 for accommodating the impact member 20, with respect to the periphery of the rotor. Thus, said cavity is exposed to only minimal soiling hazard.

For installation of the impact member, the limiting plate 26 is retracted to free the radially outer opening 16 of the accommodating cavity 14 for the impact member 20. Then the wedge 22 is loosely inserted into the side of the accommodating cavity 14 which is not overlapped by the abutment beam 18, following which the impact member 20 is also loosely inserted into the accommodating cavity 14. Next, the limiting plate 26 is shifted again into its position shown in FIG. 1, and is fixed with the aid of the screw 28. In this position one already has the impact member 20 loosely pre-positioned. However, said member is not yet wedged.

If the machine is now started, the impact member 20 will be urged radially outward such that one of its supporting thrust members 24 comes to abut upward against the lower side of the abutment beam 18. The center of inertia of the wedge 22 is closer to the rotational axis 12 and therefore the wedge experiences less centrifugal force per unit mass. Shortly after the termination of the outward movement of member 20, the wedge 22 completes movement from its rest position where it is in a disengaged state, radially outwardly to its wedged position. During this movement of the wedge 22 its nearly radially oriented rear side is urged against the also nearly radially oriented side wall of the cavity 14 for accommodating the impact member 20, and the inclined wedge surface of the wedge 22 travels along the impact member 20, wherein eventually the impact member 20 becomes fixedly wedged in the rotor. The inclination angle of the wedge 22 is chosen such that jamming of the wedge 22 does not occur. Accordingly, when the rotation of the rotor 10 is later stopped the wedge 22 can be loosened (or will loosen itself) without problems.

The invention ensures that the impact member 20 can be positioned and wedged without the difficulties presented by soiling. The proper wedging of the impact member reliably counters the tendency for the impact member 20 to shift or tilt when the coarse reduction impact crusher is in operation. After the rotor is stopped, this secure fixing of the impact member 20 is released or readily releasable on account of the disappearance of the centrifugal force when the rotor is stopped, which force had held the parts together.

I claim:

1. A coarse reduction impact crusher comprising a rotor containing a plurality of impact members which are fixable in respective accommodating cavities in the rotor; one of said accommodating cavities comprising a radially outwardly facing opening and being at least in part narrowed by an abutment beam which extends tangentially over said one accommodating cavity, each impact member in use being fixed in its respective cavity by at least one wedge member, such that at least one impact member is slidably disposed within each accommodating cavity along with at least one wedge member moveable under the influence of centrifugal force resulting from rotation of the rotor in a direction at least approximately radial, whereby at least one wedge member moves from a disengaged position close to the rotational axis of the rotor, to a wedged position distant from the rotational axis, and wherein a distance of the center of inertia of said impact member from the rotational axis is greater than a distance of the center of inertia of said wedge member from the rotational axis; said wedge member having a wedge inclination region which contacts the impact member in use to prevent jamming of said wedge member.

2. The coarse reduction impact crusher of claim 1 wherein one impact member and one wedge member are disposed within said one accommodating cavity.

3. The coarse reduction impact crusher of claim 1 further comprising a limiting plate releasably fixed to the rotor and extending over said radially outwardly facing opening of said accommodating cavity.

4. The coarse reduction impact crusher of claim 3 wherein said abutment beam is located on one side of said radially outwardly facing opening of said accommodating cavity and said releasably fixed limiting plate is located on the other side of said outwardly facing opening such that said wedge member is disposed below said limiting plate.

5. The coarse reduction impact crusher of claim 1 wherein said impact member is provided with a breaking loci such that when said impact member is over stressed, breakage of said member occurs at said loci.

6. The coarse reduction impact crusher of claim 1 wherein said impact member comprises two thrust members symmetrically disposed on the radially disposed surface of said impact member.

7. The coarse reduction impact crusher of claim 6 wherein said thrust members extend along the radially disposed surfaces of the impact member.

8. A coarse reduction impact crusher comprising a rotor containing a plurality of impact members which are fixable in respective accommodating cavities in the rotor; each impact member in use being fixed in its respective cavity by at least one wedge member, such that at least one impact member is slidably disposed within each accommodating cavity along with at least one wedge member moveable under the influence of centrifugal force resulting from rotation of the rotor, whereby at least one wedge member moves from a disengaged position close to the rotational axis of the rotor, to a wedged position distant from the rotational axis and wherein each accommodating cavity comprises a radially outwardly facing opening being at least in part narrowed by an abutment beam which extends tangentially over said accommodating cavity such that when said impact member and said wedge member are in the wedged position, said abutment beam is engaged on its lower side by a thrust member affixed to said impact member.

9. The coarse reduction impact crusher of claim 8 wherein said impact member and said wedge member move in a direction at least approximately radial.

10. The coarse reduction impact crusher of claim 8 wherein a distance of the center of inertia of said impact member from the rotational axis is greater than a distance of the center of inertia of said wedge member from the rotational axis.

11. The coarse reduction impact crusher of claim 8 wherein said wedge member further comprises a wedge inclination region which contacts said impact member in use to prevent jamming of the impact member.

* * * * *